US007469053B2

(12) United States Patent
Langberg

(10) Patent No.: US 7,469,053 B2
(45) Date of Patent: Dec. 23, 2008

(54) STAND SYSTEM WITH INTEGRATED ELECTRICAL PLUG FOR PORTABLE ELECTRONIC DEVICES

(75) Inventor: Eric Aaron Langberg, Milford, PA (US)

(73) Assignee: Plantronics, Inc., Santa Cruz, CA (US)

( * ) Notice: Subject to any disclaimer, the term of this patent is extended or adjusted under 35 U.S.C. 154(b) by 0 days.

(21) Appl. No.: 11/106,720

(22) Filed: Apr. 15, 2005

(65) Prior Publication Data

US 2006/0233414 A1 Oct. 19, 2006

(51) Int. Cl.
*H04R 1/02* (2006.01)

(52) U.S. Cl. ..... 381/388; 381/332

(58) Field of Classification Search ..... 381/87, 381/332, 333, 334, 335, 336, 366, 361, 386, 381/387, 394, 395, 388
See application file for complete search history.

(56) References Cited

U.S. PATENT DOCUMENTS

| | | | | |
|---|---|---|---|---|
| 4,943,703 | A | 7/1990 | Duxbury | 219/247 |
| 5,128,501 | A | 7/1992 | Urouiola | 200/51.09 |
| 5,138,351 | A | 8/1992 | Wiegand et al. | 354/81 |
| D351,388 | S | 10/1994 | Ballard et al. | D14/214 |
| D368,717 | S | 4/1996 | Lenart et al. | D14/211 |
| 5,614,688 | A * | 3/1997 | Donnell | 84/743 |
| 5,834,920 | A | 11/1998 | Daniel | 320/2 |
| 5,847,922 | A | 12/1998 | Smith et al. | 361/685 |
| 6,038,314 | A | 3/2000 | Dynie et al. | 379/435 |
| 6,154,010 | A | 11/2000 | Geiger | 320/137 |
| 6,366,450 | B1 | 4/2002 | Janicek | 361/680 |
| 6,447,451 | B1 | 9/2002 | Wing et al. | 600/437 |
| D489,054 | S | 4/2004 | Weikel et al. | D14/211 |
| D508,689 | S | 8/2005 | Schul et al. | D14/172 |
| 2003/0174855 | A1 * | 9/2003 | Hawkins et al. | 381/386 |
| 2004/0091124 | A1 * | 5/2004 | Chua et al. | 381/104 |
| 2005/0244025 | A1 | 11/2005 | Schul et al. | 381/334 |

* cited by examiner

*Primary Examiner*—Walter F Briney, III
(74) *Attorney, Agent, or Firm*—Greenberg Traurig LLP

(57) ABSTRACT

A stand system with an integrated electrical plug for portable electronic devices such as speakers and the like includes a housing with a resting surface, the housing having a desired position upon a support surface. A female fitting is operably connected to the housing for conducting electrical signals. A male fitting integrated with a housing stand is further provided, the male fitting adapted to mate with the female fitting and conduct electrical signals. Mating the male fitting with the female fitting causes the housing stand to provide support for the housing, in combination with the resting surface, permitting the housing to maintain the desired position upon the surface, and permitting electrical signals to be conducted between the male fitting and the female fitting. The invention may be used for a variety of portable electronic devices, including, but not limited to, portable speakers, portable digital assistants (PDAs), handheld computers, and portable media players for playback of audio or video in either digital or analog format.

43 Claims, 7 Drawing Sheets

STAND SYSTEM WITH INTEGRATED ELECTRICAL PLUG FOR PORTABLE ELECTRONIC DEVICES

This application includes material which is subject to copyright protection. The copyright owner has no objection to the facsimile reproduction by anyone of the patent disclosure, as it appears in the Patent and Trademark Office files or records, but otherwise reserves all copyright rights whatsoever.

FIELD OF THE INVENTION

The present invention relates to the field of systems for supporting portable electronic devices.

BACKGROUND OF THE INVENTION

Portable electronic devices often require an electrical input from an external source such as an audio source, a data source, or a power supply. Such portable devices include, but are not limited to, portable speakers, portable digital assistants (PDAs), handheld computers, and portable media players for playback of audio or video in either digital or analog format.

Often, such portable electronic devices need to rest on a generally flat surface, such as a desktop or table top, at a desired angle such that they can be optimally viewed, heard, or operated by a user. A broad, flat base is often provided at the bottom surface of such devices or their docking cradles such that the device can rest at the desired angle on a surface without external support. However, such broad, flat bases limit portability of the electronic device in that they add to the bulk and weight of the device.

Loudspeakers in particular are subject to these limitations. Conventional speakers typically include a broad, flat base so that the speaker can stand on a flat surface at an angle of approximately 70-90 degrees with respect to the surface. At this angle, sound is projected from the speaker toward the listener. However, conventional speakers are often bulky and limit a traveler's valuable space. Even conventional portable speakers are often too bulky to be enclosed in a compact carrying case suitable for travel.

SUMMARY OF THE INVENTION

Accordingly, the present invention is directed to a stand system for electronic devices that substantially obviates one of more problems due to limitations and disadvantages of the related art. The invention provides a removable stand system with an integrated electrical plug configured to support an electronic device at an angle appropriate for use or operation of the device.

In one embodiment, the invention provides a system for conducting electrical signals with a housing having a resting surface, the housing having a desired position upon a support surface. A female fitting is operably connected to the housing for conducting electrical signals. A male fitting integrated with a housing stand is further provided, the male fitting adapted to mate with the female fitting and conduct electrical signals. Mating the male fitting with the female fitting causes the housing stand to provide support for the housing, in combination with the resting surface, permitting the housing to maintain the desired position upon the surface, and permitting electrical signals to be conducted between the male fitting and the female fitting. The invention may be used for a variety of portable electronic devices, including, but not limited to, portable speakers, portable digital assistants (PDAs), handheld computers, and portable media players for playback of audio or video in either digital or analog format.

In another embodiment, the invention includes a kit for providing a portable speaker system having a combined electrical plug and support leg. The kit includes a speaker housing, the speaker housing having at least one speaker driver mounted therein, a resting surface for resting upon a generally flat surface, and a jack for removably receiving an electrical plug. An electrical plug and electrical cable connected thereto are further provided in the kit, the electrical plug forming a support leg when mated with the jack. The support leg partially supports the speaker housing such that the speaker housing can be retained in a desired position when the plug is plugged into the jack and the speaker housing is resting upon the generally flat surface. The kit may include a compact travel case suitable to receive two of the speakers along with the electrical plug and electrical cable.

In another embodiment, the invention provides portable speakers with a removable base. The removable base has an integrated electrical plug that may be used, e.g., to couple the left and right speakers. In an alternative embodiment, a docking station for a laptop computer has a base with the integrated wire. The speakers may be powered by a Universal Serial Bus ("USB") cable, eliminating the need for carrying extra batteries, or may be battery operated.

In one embodiment, a speaker system comprises: a speaker housing comprising a top side, bottom side, front and rear sides, and left and right sides, wherein the speaker housing is configured to be oriented such that the front side is directed towards an intended user and the bottom side is directed towards a support surface; at least one speaker driver connected to the speaker housing and configured to reproduce sound; a recess on the speaker housing; a first connection component located at a distal end of the recess; and a base component comprising: a bottom surface configured to rest on the support surface; and a base member extending from the bottom surface and comprising a second connection component on a surface other than the bottom surface that is configured to removably mate with the first connection component of the speaker housing to provide an electrical connection, the base member configured to be received in the recess, wherein the recess is configured to receive the base member such that when the first connection component and second connection component are mated, the base component provides support to maintain the speaker housing at a desired angle.

In one aspect, the base component is configured to maintain the speaker housing in a desired position on a support surface at an angle of approximately 90 to 115 degrees relative to the support surface, and preferably at an angle that is between 95 and 105 degrees relative to the support surface.

In another aspect, the first connection component comprises a plug and the second connection component comprises an input, or vice versa. The speaker housing may further comprise an auxiliary audio input and/or a power input, which may be a USB port.

According to a further embodiment, a speaker system comprises: a speaker enclosure having an input; and a speaker stand having an integrated plug, wherein the plug is removably receivable in the input, and wherein the speaker stand is configured to support the speaker enclosure and receive the plug in the input.

According to another embodiment, a speaker stand system comprises: a base configured to receive an audio input and comprising a first contact configured to transmit the audio input; and a speaker enclosure comprising: a resting surface;

at least one speaker driver; and a second contact configured to receive the audio input from the first contact of the base, wherein the base is removably couplable to the speaker enclosure both to provide the audio input to the at least one speaker driver and to add support to the speaker enclosure such that the speaker enclosure is retained in a position that directs sound from the at least one speaker driver to a desired listening area.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of at least one embodiment of the invention.

In the drawings.

DETAILED DESCRIPTION OF THE PREFERRED EMBODIMENT

Reference will now be made in detail to the preferred embodiments of the present invention, examples of which are illustrated in the accompanying drawings.

Figure 1:
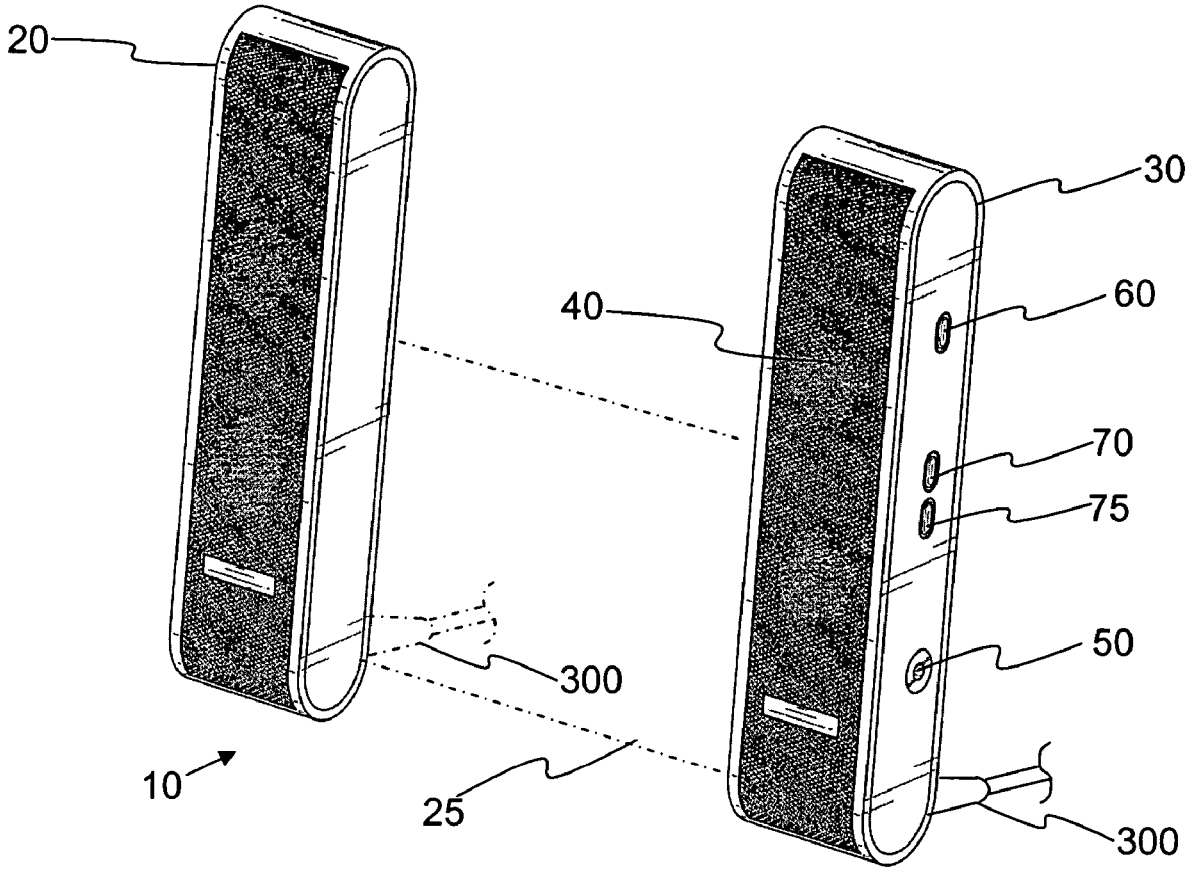
FIG. 1 is a frontal perspective view of a pair of speakers incorporating the present invention.

Referring to FIG. 1, a speaker system 10 has a pair of speakers 20, 30 with a recess for receiving base component or stand 300 having an electrical connector integrated therewith. Speakers 20, 30 each have at least one speaker driver 40 on a front side of housings 20, 30. The speaker drivers may be provided in the form of, e.g., four full-range neodymium micro drivers with aluminum cones. Preferably, speakers 20, 30 are each configured as an elongated structure having substantially flat front, rear, and side surfaces. This configuration provides a lightweight speaker designed for convenient packing.

The speakers 20, 30 may comprise individual free-standing speaker housings. Alternatively, the speaker housing may include a cross member 25 extending from speaker 20 to speaker 30 such that the speakers are mechanically connected to one another. In such embodiments, the base component or stand 300 may mate with the cross member portion of the housing.

On a side of speaker 30 is an auxiliary input 50 for an additional sound source, such as a laptop computer, a personal media player, a CD player, or the like. A power button 60 and volume controls 70, 75 are also positioned on the side of speaker 30.

Figure 2:
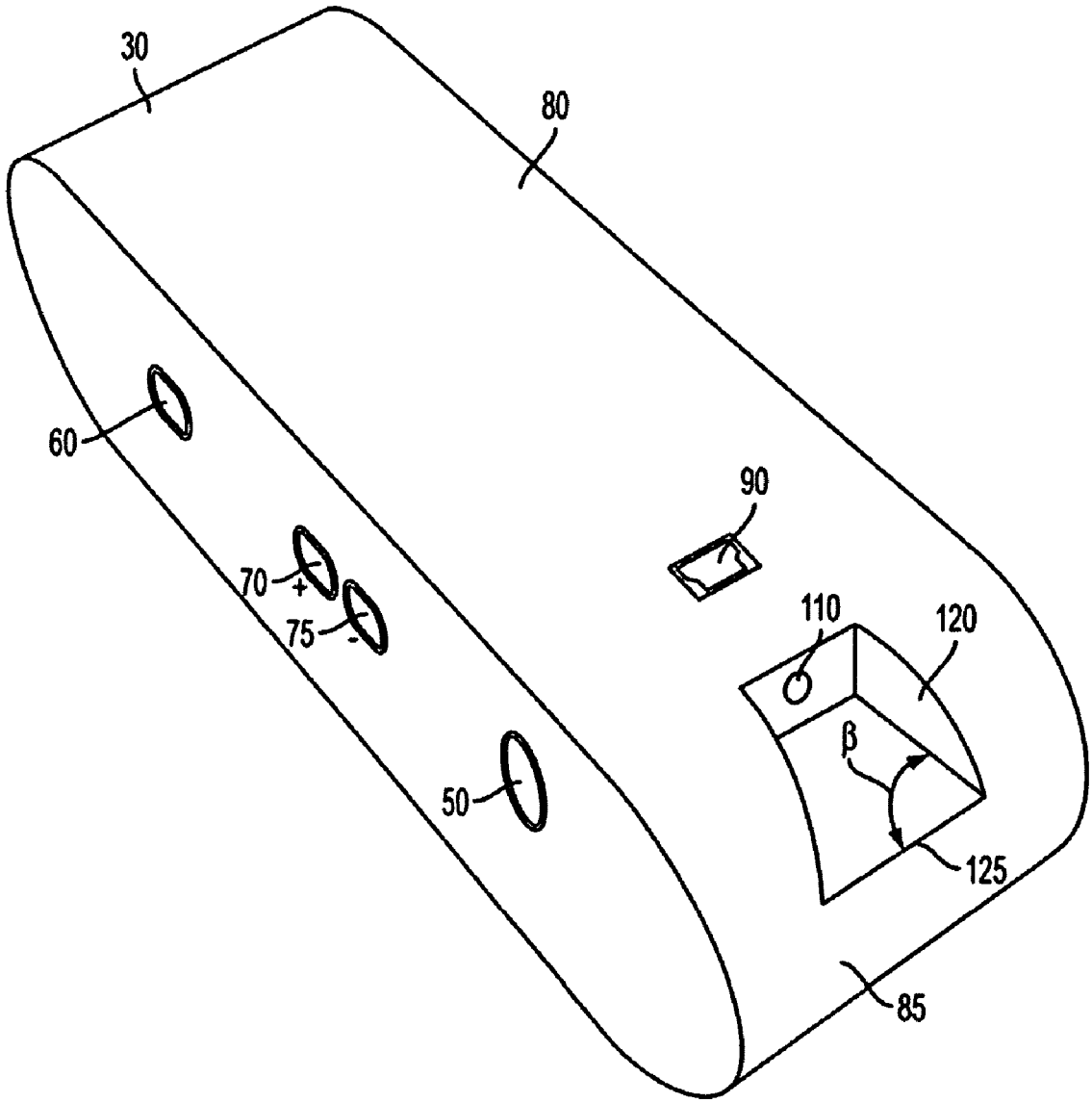
FIG. 2 is a rear perspective view of a speaker according to an embodiment of the present invention.

Referring to FIG. 2, a Universal Serial Bus ("USB") port 90 is positioned on a rear side 80 of speaker 30. Through the USB port, a computer can provide power as well as an audio signal or input. Alternatively, the speakers 20, 30 may be powered and/or receive an audio signal by other means known to one of ordinary skill in the art.

Figure 3A:
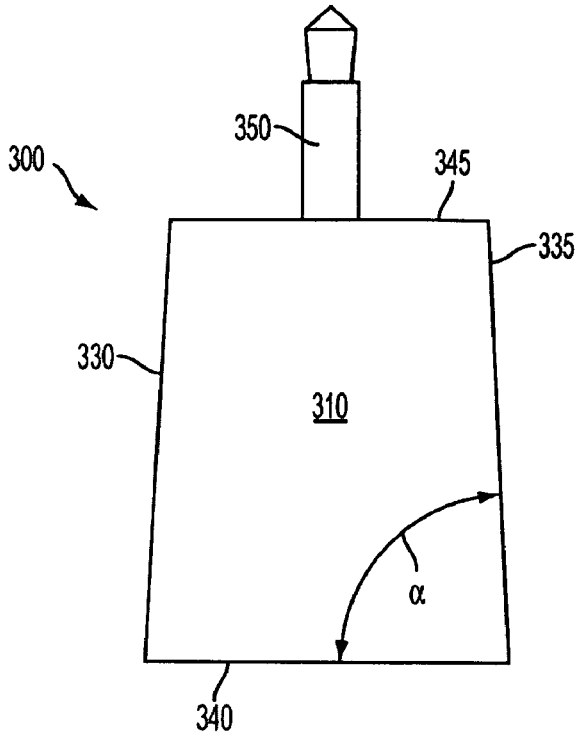
FIGS. 3*a*-3*c* are side views of a stand according to an embodiment of the present invention.
Figure 3B:
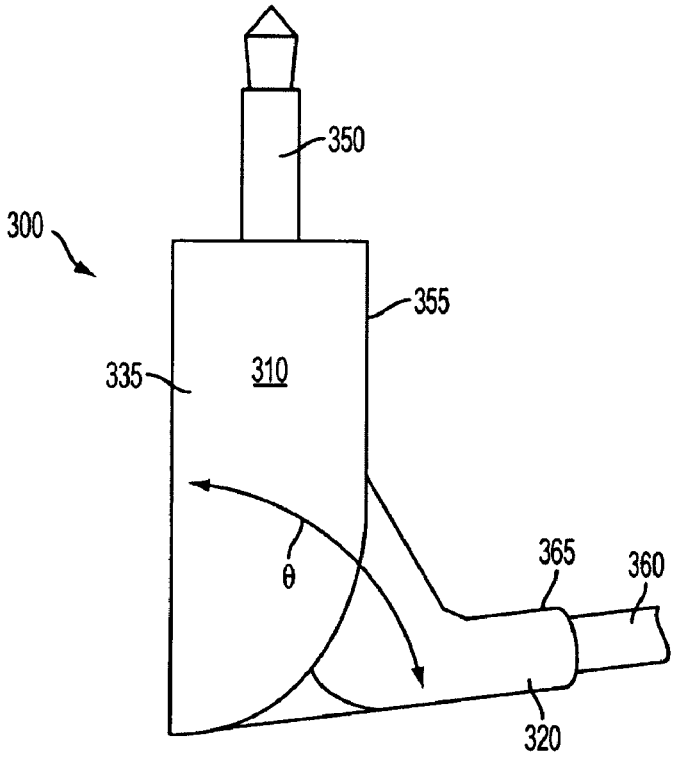
Figure 3C:
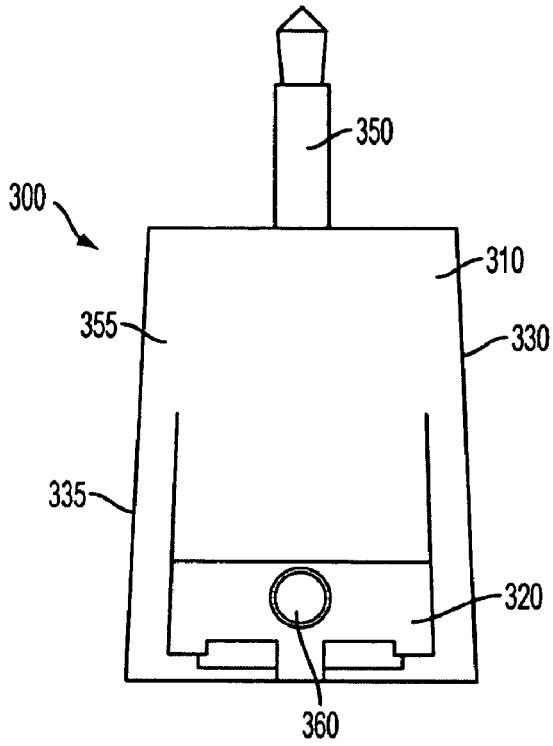
Figure 3D:
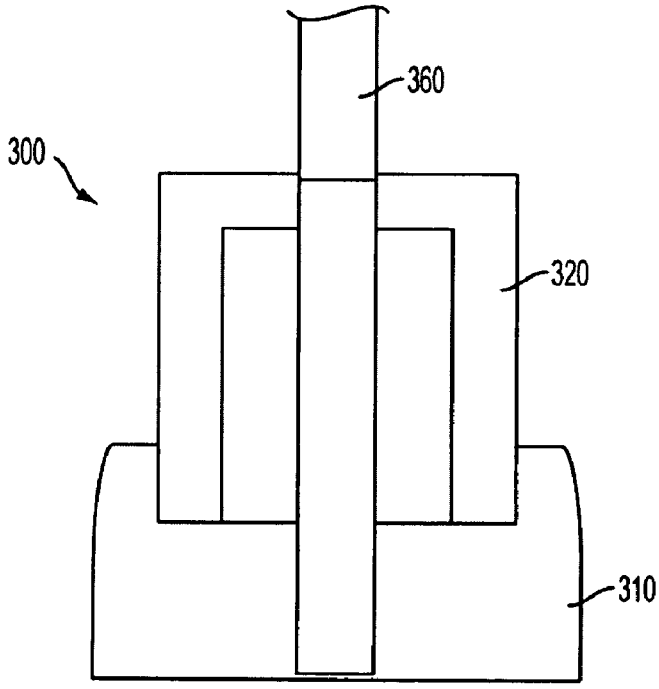
FIG. 3*d* is a bottom view of a stand according to an embodiment of the present invention.

A recess 120 is positioned on an edge (e.g., a rounded edge, as shown in FIG. 2) between rear side 80 and bottom side 85. Recess 120 has a port (e.g., a first connection component, fitting or jack) 110 located at the distal end of recess 120 for receiving or transmitting an audio signal. Speaker 20 has a substantially identical port (not shown). Speakers 20, 30 each engage a speaker stand 300 (FIG. 3*a*) at recess 120 for support and audio signal/input transmission.

Referring to FIGS. 3*a*-3*d*, a stand 300 used to support each speaker 20, 30 is shown. Base component or stand 300 comprises a base member 310 and a side component 320. Base member 310 is configured to be securely coupled to speakers 20, 30. The shape of base member 310 is substantially configured to be received by recess 120 of a speaker 20, 30. Specifically, side walls 330, 335 are each at an angle $\alpha$ from the bottom surface 340. Angle $\alpha$ is substantially identical to an angle $\beta$ between a side and bottom 125 of recess 120 (FIG. 2). Angles $\alpha$, $\beta$ are each preferably approximately 80 to 90 degrees. In a preferred embodiment, angles $\alpha$, $\beta$ are each approximately 87 degrees. The substantially identical configurations of the stand 300 and the recess 120 ensure a secure engagement.

Side component 320 extends from a rear side 355 of base member 310 and provides support to base member 310 and the speaker 20, 30 when stand 300 is therewith engaged. When base member 310 is engaged with a speaker 20, 30, side component 320 extends from the combined unit to provide support for the speaker 20, 30 in a desired position. An angle $\theta$ between the front side 370 of base member 310 and a bottom surface 340 of base component or stand 300 provides a desired angle for the speakers to reproduce sound. Angle $\theta$ is preferably approximately 75 to 90 degrees. Preferably, angle $\theta$ is approximately 83 degrees.

When the stand 300 is supporting speaker 20, 30, angle $\theta$ of stand 300 causes speaker 20, 30 to maintain a desired position, which, in a preferred embodiment is at angle $\theta$ or slightly less. In order to obtain the optimum angle for reproducing sound to a desired listening audience, speakers 20, 30 are positioned at an angle commensurate with angle $\theta$.

A plug (e.g., a second connection component) 350 extending from a top side 345 of base member 310 of stand 300 is receivable by port 110 of a speaker 20, 30. Alternatively, a plug can be positioned on the speaker 20, 30 and the port can be positioned on the stand 300. When engaged, port 110 and plug 350 provide a connection for an audio signal transmission between stand 300 and speakers 20, 30.

A wire 360 connects to plug 350 and extends through base member 310 and through side component 320, where it exits at a side component tip 365. Wire 360 then extends a sufficient length to connect to a substantially identical stand for the other speaker 20, 30. Wire 360 communicatively couples speaker 20 with speaker 30. As a result, the audio source (e.g., computer, CD player, MP3 player) only needs to provide an audio signal to speaker 30, which in turn transmits the appropriate signal to speaker 20 through wire 360. In a preferred embodiment, a stereo audio signal is input to speaker 30 via USB port 90. The signal may be received in a digital format and decoded into a stereo analog signal by a decoder within speaker 30. Speaker driver(s) 40 of speaker 30 reproduce sound from one channel of the stereo audio signal, and an audio signal corresponding to the other channel is transmitted to the other speaker 20 via wire 360. In other embodiments, the audio signal input to speaker 30 may be monaural or may include more than two channels, and wire(s) 360 may connect more than two speakers to reproduce sound corresponding to all channels. Similarly, power may be provided to speaker 30 and delivered to speaker 20 through wire 360. Alternatively or in addition, speaker 30 may include an amplifier circuit (not shown) to amplify the audio signal received via USB port 90 using power delivered (also via USB port 90). This amplified audio signal may drive speaker driver(s) 40 of speaker 30 and may be transmitted to speaker 20 via wire 360 to drive speaker driver(s) 40 of speaker 20.

Figure 4:
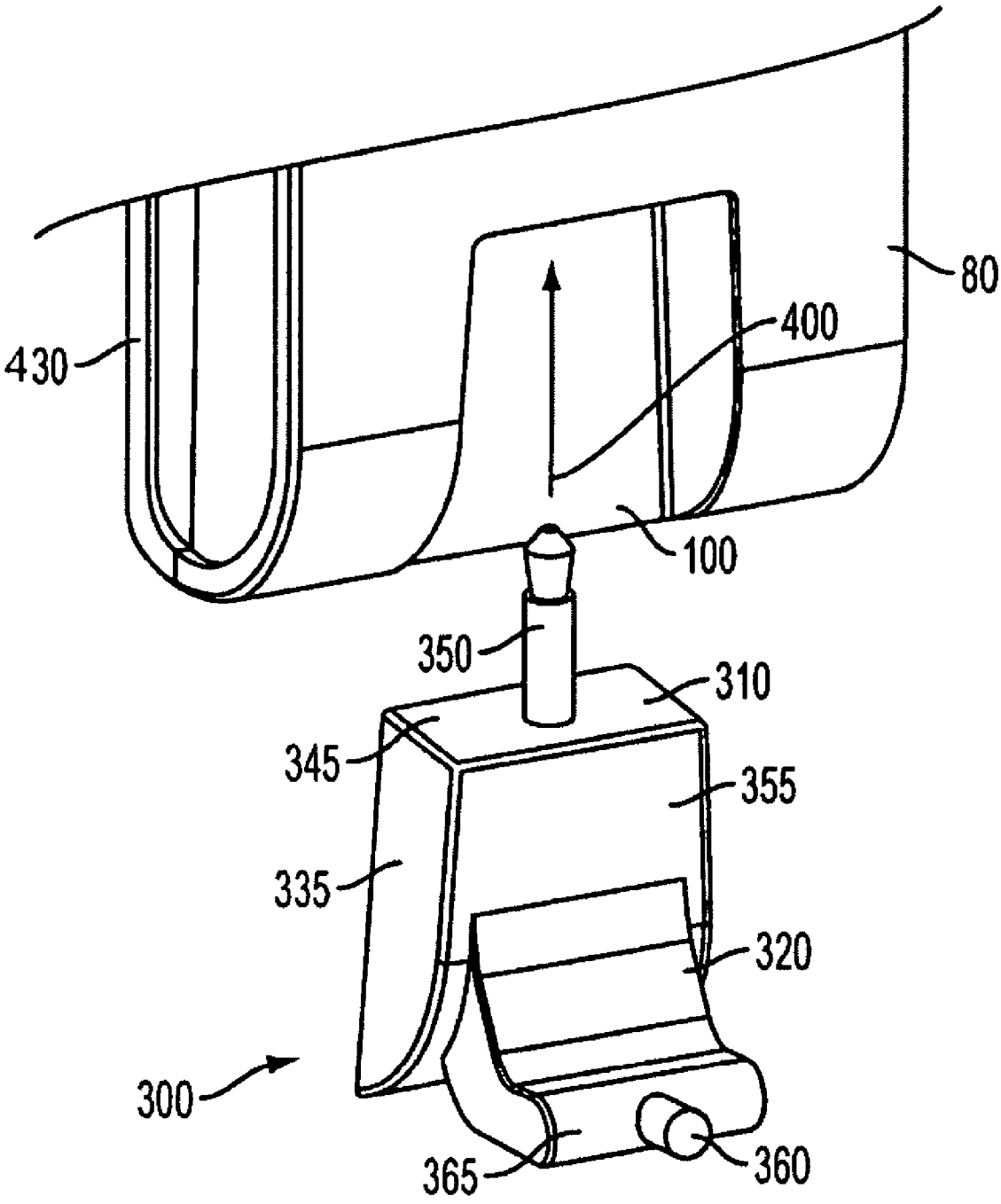
FIG. 4 is a perspective view of the engagement of a stand with a portable electronic device according to an embodiment of the present invention.

Referring to FIG. 4, stand 300 is inserted in a direction 400 into recess 100 of portable electronic device 430. The portable electronic device may be, e.g., a speaker system, portable digital assistant (PDA), handheld computer, or portable media player for playback of audio or video in either digital or analog format. Recess 100 is configured to receive stand 300 such that plug 350 is coupled to the housing of device 430 and the base member 310 is substantially enveloped by the housing. Base member 310 extends to the boundaries of recess 100 to become substantially integrated with the shape of portable electronic device 430. As a result, side component 320 appears to be extending from the housing.

Figure 5:
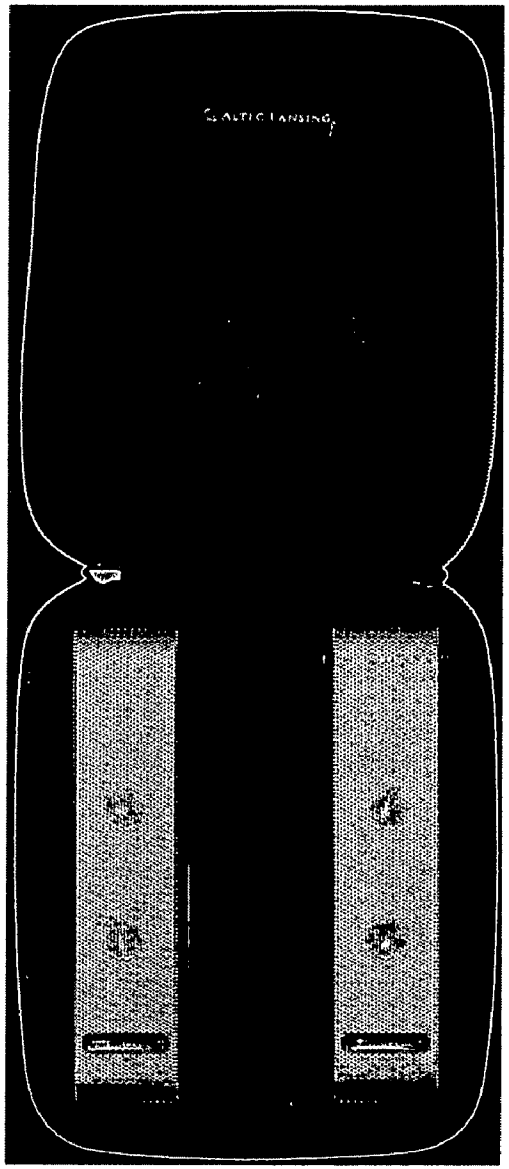
FIG. 5 is a top view showing a compact travel case suitable to receive a pair of speaker housings along with an electrical plug and electrical cable according to the invention.

In an alternative embodiment, the stand 300 is integrated into a docking station for a laptop computer. When a traveler docks the laptop computer in the docking station, speakers 20, 30 are communicatively coupled to the docking station such that it supports speakers 20, 30 and provides an audio source, in a manner similar to stand 300. When the traveler uses speakers 20, 30 at a location other than the docking station, the traveler uses stand 300 alone without the docking station. The size and configuration of stand 300 and speakers 20, 30 are desirable for portability and sound quality. FIG. 5 illustrates a compact travel case suitable to receive a pair of speaker housings along with an electrical plug and electrical cable according to the invention.

Figure 6:
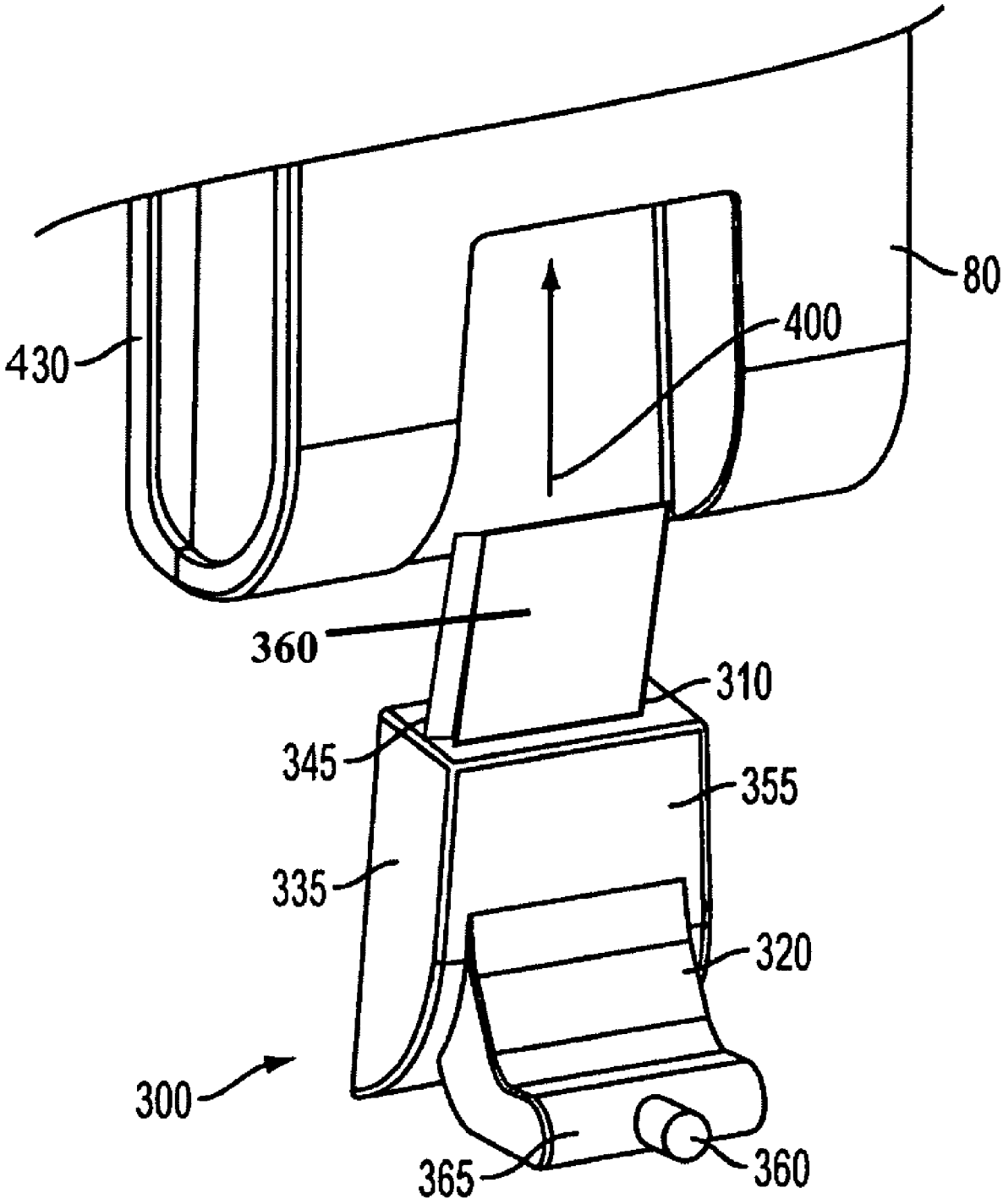
FIG. 6 is a perspective view of the engagement of a stand having a USB connector with a portable electronic device according to an embodiment of the present invention.

FIG. 6 shows an embodiment of the invention having the features described above with respect to FIG. 4, except that a USB plug 360 is provided in place of the ⅛" stereo plug of FIG. 4. The USB plug 360 may be male or female, and may be of any appropriate form factor. Those of ordinary skill in the art will recognize that other plugs, fittings, connectors, and the like, including but not limited to IEEE 1394 connectors, network connectors, serial connectors, parallel connectors, ¼ phono plugs, and proprietary data connectors can be used without departing from the spirit and scope of the invention.

While the invention has been described in detail and with reference to specific embodiments thereof, it will be apparent to those skilled in the art that various changes and modifications can be made therein without departing from the spirit and scope thereof. For example, while various embodiments utilize the invention in connection with portable speakers, the invention may be used for a variety of other electronic devices, including, but not limited to, portable digital assistants (PDAs), handheld computers, and portable media players for playback of audio or video in either digital or analog format. Thus, it is intended that the present invention cover modifications and variations of this invention provided they come within the scope of any of the appended claims and their equivalents.

What is claimed is:

1. A speaker system comprising:

a speaker housing comprising top and bottom sides, front and rear sides, and left and right sides, wherein the speaker housing is configured to be oriented such that the front side is directed towards an intended user and the bottom side is directed towards a support surface which is substantially flat in contour and substantially parallel in orientation to a floor;

at least one speaker driver connected to the speaker housing and configured to reproduce sound;

a recess on the speaker housing;

a first connection component located at a distal end of the recess; and a base component comprising:

a bottom surface configured to rest on the support surface; and a base member extending from the bottom surface and comprising a second connection component on a surface other than the bottom surface that is configured to removably mate with the first connection component of the speaker housing to provide an electrical connection, the base member configured to be received in the recess, wherein the recess is configured to receive the base member such that when the first connection component and second connection component are mated, the base component provides support to enable the speaker housing to remain at rest in a desired substantially upright position on said support surface.

2. The speaker system of claim 1, wherein the base component is configured to maintain the speaker housing at an angle of approximately 90 to 115 degrees relative to the support surface.

3. The speaker system of claim 1, wherein the base component is configured to maintain the speaker housing at an angle of approximately 95 to 105 degrees relative to the support surface.

4. The speaker system of claim 1, wherein the base component is configured to be integrated in a docking station.

5. The speaker system of claim 1, wherein the first connection component comprises a plug and the second connection component comprises an input.

6. The speaker system of claim 1, wherein the first connection component comprises an input and the second connection component comprises a plug.

7. The speaker system of claim 1, wherein the speaker housing further comprises an auxiliary audio input.

8. The speaker system of claim 1, wherein the speaker housing further comprises a power input.

9. The speaker system of claim 8, wherein the power input comprises a USB port.

10. A speaker system comprising:

a speaker housing having a first electrical fitting and a resting surface for resting on a support surface which is substantially flat in contour and substantially parallel in orientation to a floor; and a speaker stand having an integrated second electrical fitting adapted to mate with the first electrical fitting, wherein the second electrical fitting is removably matable with the first electrical fitting, and wherein the speaker stand is configured to enable the speaker housing to remain at rest in a substantially upright position on the support surface when the first and second electrical fittings are mated.

11. The speaker system of claim 10, wherein the speaker stand is configured to maintain the speaker housing at an angle of approximately 90 to 115 degrees relative to a support surface.

12. The speaker system of claim 10, wherein the speaker stand is configured to maintain the speaker housing at an angle of approximately 95 to 105 degrees relative to a support surface.

13. The speaker system of claim 10, wherein the speaker stand is configured to be integrated into a docking station.

14. The speaker system of claim 10, wherein the speaker housing further comprises an auxiliary audio input.

15. The speaker system of claim 10, wherein the speaker housing further comprises a power input.

16. The speaker system of claim 15, wherein the power input comprises a USB port.

17. A speaker stand system comprising:

a base configured to receive an audio signal and comprising a first contact configured to transmit the audio signal; and a speaker housing comprising:

at least one speaker driver; and a second contact configured to receive the audio signal from the first contact of the base;

wherein the base is removably couplable to the speaker housing both to provide the audio signal for the at least one speaker driver and to enable the speaker housing to remain at rest in a substantially upright position on a support surface which is substantially flat in contour and substantially parallel in orientation to a floor in a position that directs sound from the at least one speaker driver to a desired listening area.

18. The speaker stand system of claim 17, wherein the base is configured to support the speaker housing at an angle of approximately 90 to 115 degrees relative to a support surface.

19. The speaker stand system of claim 17, wherein the base is configured to support the speaker housing at an angle of approximately 95 to 105 degrees relative to a support surface.

20. The speaker stand system of claim 17, wherein the base is configured to be integrated in a docking station.

21. The speaker stand system of claim 17, wherein the first contact comprises a plug and the second contact comprises an input.

22. The speaker stand system of claim 17, wherein the first contact comprises an input and the second contact comprises a plug.

23. The speaker stand system of claim 17, wherein the speaker housing further comprises an auxiliary audio input.

24. The speaker stand system of claim 17, wherein the speaker housing further comprises a power input.

25. The speaker stand system of claim 24, wherein the power input comprises a USB port.

26. A system for conducting electrical signals comprising:

a housing having a resting surface, the housing having a desired position upon a support surface which is substantially flat in contour and substantially parallel in orientation to a floor;

a first fitting operably connected to the housing for conducting electrical signals;

a second fitting integrated with a housing stand, the second fitting adapted to mate with the first fitting and to conduct electrical signals;

wherein mating the second fitting with the first fitting causes the housing stand to provide support for the housing, in combination with the resting surface, enabling the housing to maintain the desired position at rest in a substantially upright position upon the support surface, and permitting electrical signals to be conducted between the second fitting and the first fitting.

27. The system for conducting electrical signals according to claim 26, wherein the first fitting is a female fitting and the second fitting is a male fitting.

28. The system for conducting electrical signals according to claim 26, wherein the electrical signals are audio signals.

29. The system for conducting electrical signals according to claim 26, wherein the electrical signals are digital signals.

30. The system for conducting electrical signals according to claim 26, wherein housing receives external power.

31. The system for conducting electrical signals according to claim 26, wherein the first fitting is a $\frac{1}{8}^{th}$ in stereo jack.

32. The system for conducting electrical signals according to claim 26, wherein the first fitting is a female USB connector and the second fitting is a male USB connector.

33. The system for conducting electrical signals according to claim 26, wherein the first fitting is a male USB connector and the second fitting is a female USB connector.

34. The system for conducting electrical signals according to claim 26, wherein the housing is a multi-part housing.

35. The system for conducting electrical signals according to claim 26, wherein the housing is one or more speaker enclosures.

36. The system for conducting electrical signals according to claim 26, wherein the housing includes a USB jack for receiving audio signals and power.

37. The system for conducting electrical signals according to claim 26, wherein the housing comprises two speaker enclosures, the first speaker enclosure including an amplified audio out jack for sending a channel of analog audio to the second speaker enclosure.

38. The system for conducting electrical signals according to claim 26, wherein the housing has integrated therein a decoder for converting a digital audio signal to an analog audio signal.

39. The system for conducting electrical signals according to claim 38, wherein the housing further has integrated therein an amplifier for amplifying the analog audio signal.

40. The system for conducting electrical signals according to claim 39, wherein the housing comprises first and second speaker enclosures, wherein the decoder and amplifier are integrated into the first speaker enclosure, and wherein one channel of the amplified analog audio signal is transmitted to the second speaker enclosure via an electrical conductor.

41. A kit for providing a portable speaker system having a combined electrical plug and support leg, comprising:

a speaker housing, the speaker housing having:

at least one speaker driver mounted thereto;

a resting surface for resting upon a a support surface which is substantially flat in contour and substantially parallel in orientation to a floor;

a female connector for removably receiving a male electrical plug;

a male electrical plug and electrical cable connected thereto, the electrical plug forming a support leg when mated with the jack;

whereby the support leg partially supports the speaker housing such that the speaker housing can be retained in a desired position when the plug is plugged into the connector and the speaker housing is at rest in a substantially upright position upon the support surface.

42. The kit according to claim 41, further comprising:

a compact travel case suitable to receive the speaker housing along with the electrical plug and electrical cable.

43. The kit according to claim 41, further comprising:

a second speaker housing; and a compact travel case suitable to receive two speaker housings along with the electrical plug and electrical cable.

* * * * *